US006125537A

United States Patent [19]

Kuehl

[11] Patent Number: 6,125,537

[45] Date of Patent: Oct. 3, 2000

[54] PROCESS FOR FITTING COMPONENTS ROTATIONALLY FIXEDLY ON A SHAFT

[76] Inventor: Hans Kuehl, Kornbergweg 12, D-73207 Plochingen, Deutschland, Germany

[21] Appl. No.: 09/214,068

[22] PCT Filed: May 28, 1997

[86] PCT No.: PCT/EP97/02752

§ 371 Date: Jul. 28, 1998

§ 102(e) Date: Jul. 28, 1999

[87] PCT Pub. No.: WO97/49511

PCT Pub. Date: Dec. 31, 1997

[30] Foreign Application Priority Data

Jun. 26, 1996 [DE] Germany ..... 196 25 555

[51] Int. Cl.[7] ..... B21D 53/84; B21K 1/12

[52] U.S. Cl. ..... 29/888.1; 29/407.08; 29/523; 29/715

[58] Field of Search ..... 29/888.08, 888.1, 29/407.08, 523, 702, 715

[56] References Cited

U.S. PATENT DOCUMENTS

| | | | |
|---|---|---|---|
| 4,575,913 | 3/1986 | Sugiuchi et al. | 29/523 |
| 4,597,365 | 7/1986 | Madaffer . | |
| 4,635,333 | 1/1987 | Finch | 29/523 |
| 4,809,562 | 3/1989 | Bendoraitas et al. | 74/567 |
| 5,435,207 | 7/1995 | Orsini, Jr. | 29/888.1 |
| 5,504,995 | 4/1996 | Blanchard et al. | 29/888.1 |

FOREIGN PATENT DOCUMENTS

| | | |
|---|---|---|
| 59-104226 | of 1984 | Japan . |
| 07124670 | of 1995 | Japan . |

OTHER PUBLICATIONS

MTZ Motortechnische Zeitschrift, 57 (1996) May, No. 5, Stuttgart, DE, pp. 284–290.

*Primary Examiner*—David P. Bryant
*Assistant Examiner*—Jermie E. Cozart
*Attorney, Agent, or Firm*—Evenson, McKeown, Edwards & Lenahan, P.L.L.C.

[57] ABSTRACT

In order to fasten parts, such as cams, gear wheels, and discs, in a torsionally resistant manner on a hollow shaft, it is proposed to expand the shaft by pulling an expanding drift through the shaft after threading on the parts, which are provided with slight mating play, and consequently to establish at least frictional engagement between the shaft and the parts. A particularly secure connection can then be achieved when the bore of the parts is provided with a profiling into which the material of the shaft displaced by the expanding drift is pressed. Expansion of the shaft may be performed in stages by using an expanding drift having a staged increase in its effective diameter or successively using a plurality of expanding drifts of respectively larger effective diameter.

6 Claims, 1 Drawing Sheet

PROCESS FOR FITTING COMPONENTS ROTATIONALLY FIXEDLY ON A SHAFT

BACKGROUND AND SUMMARY OF THE INVENTION

The invention relates to a process for the torsionally resistant connection of a hollow shaft to at least one part arranged on the shaft, in which process the part is fitted with mating play onto the shaft and is fastened in a specific position on the latter by eliminating this play.

It is known to fasten cams, for example, on shafts by shrink-fitting or by expanding the tubular shaft. For shrink-fitting (DE 33 01 749 A), a heated cam can be pushed onto The shaft and shrinks securely on the said shaft by contracting during cooling. A tubular shaft can be expanded by applying appropriately high, fluidic internal pressure to achieve frictionally engaging contact with the bores of cams arranged on the shaft (DE 38 03 687 A).

It has also already been proposed (DE 36 38 310 A) to use a shaft of a cross-sectionally unround outer contour, onto which cams of correspondingly unround outer contour are fastened. The fastening of the cams on the polygonal shaft is Intended to take place by interlocking actions of the polygon shape to be brought about by expanding the polygon faces or by compressing the polygon shoulders when pushing on the cams and the subsequent springing back of the polygonal tube.

Furthermore, it has already been proposed (DE 25 46 802 C) to provide the seating of the cams with an unround design and to deform the wall of the tubular shaft into the unround seatings of the cams by generating high pressure in the space inside the shaft.

It has been found, however, that the frictional engagement which is required for the transmission of the forces occurring during operation of the shaft is not always achieved with the required reliability. The expanding of a tubular shaft by internal pressure requires considerable time to build up the very high necessary, with the result that the cycle time for this method of production, and consequently its costs, are high.

It was therefore the object of the invention to provide a simple and inexpensive possible way of fastening parts such as cams, discs, gear wheels and the Like securely on shafts, in particular such that they are secured against torsion.

The expanding of a hollow shaft by means of a drift moved through the shaft is a deforming technique which is uncomplicated and easy to carry out. The amount by which the hollow shaft has to be expanded in order to accomplish the desired secure seating of the parts is generally small and therefore does not present problems either in terms of working methods or in terms of materials. In extreme cases, the expanding may also be performed in stages, in that a plurality of drifts are moved in succession or a staged drift with increasingly larger expanding diameters is moved through the hollow shaft. With this embodiment, there is the associated advantage that the material can relax after the deforming operation before the next expanding operation follows. In this way, the risk of micro-structural damage can be avoided.

The drift may be pushed through the shaft, but it is preferred for it to be pulled.

The hollow shaft is generally circular in cross section on the inside and outside, as is the bore of a part to be fastened on the shaft. The contours of these parts coming into engagement with one another may, however, also be unround, for example oval or polygonal, and also have the same cross section as one another or a sightly different cross section from one another.

A particularly secure seating of a part to be fastened on the hollow shaft is achieved if the bore of this part has a profiling, for example in the form of a toothing, into which the material displaced during expansion of the hollow shaft flows and thus brings about a keyed connection between the part and the shaft. FIG. 1*a* is a view of a plurality of drifts which may be successively used in the process.

DETAILED DESCRIPTION OF THE INVENTION

Figure 1:
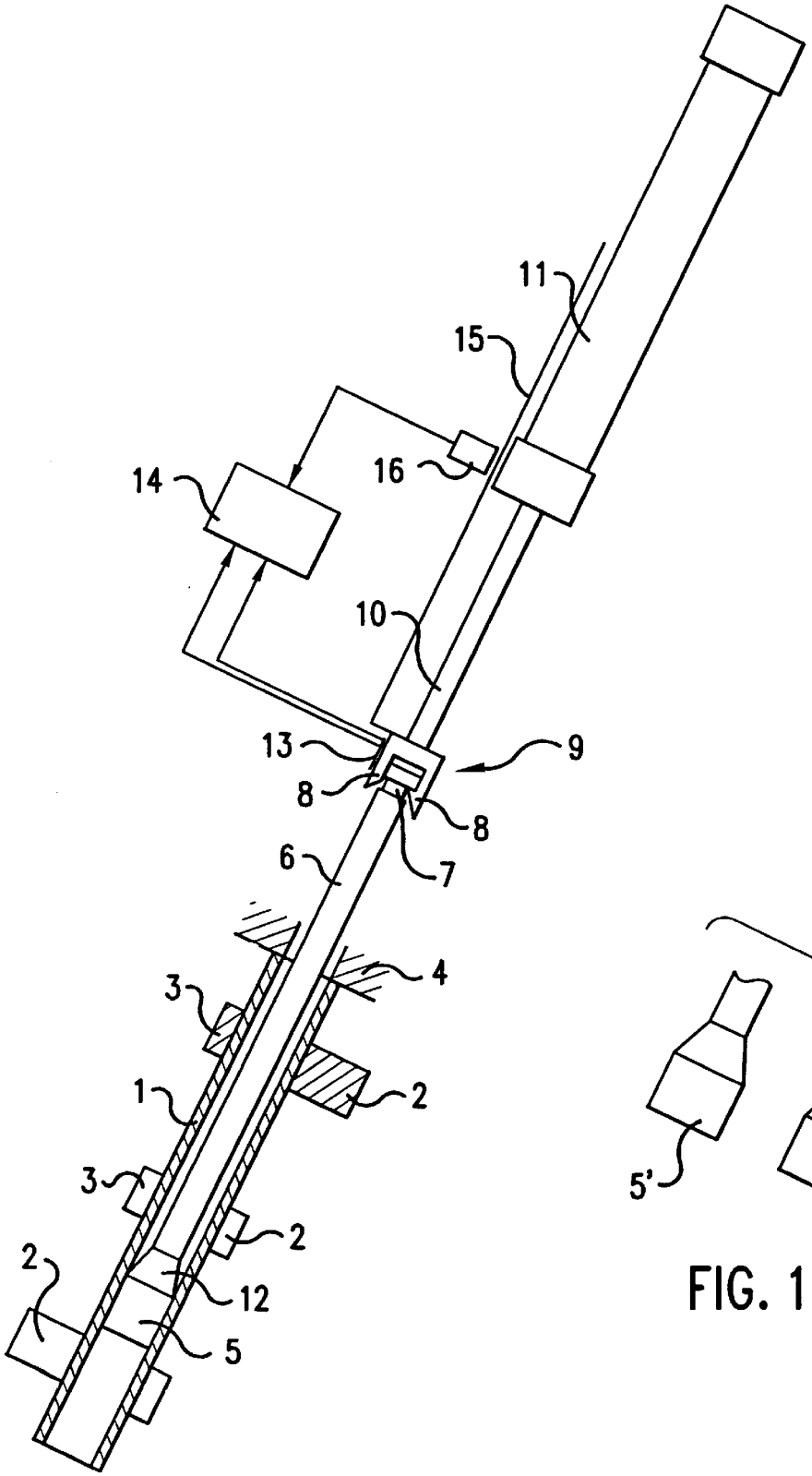
FIG. 1 illustrates an apparatus for carrying out the process of the present invention.
Figure 1A:
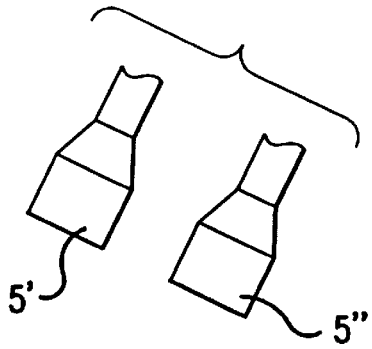

In the figure of the drawing, an apparatus suitable for carrying out the said method is represented diagrammatically and by way of example. The figure shows the apparatus during the expansion of a hollow shaft in longitudinal section through the latter. Cams have been chosen as the parts to be fastened on the shaft, but it goes without saying that the process and the apparatus may also serve for fastening parts of a different type.

On a hollow shaft 1, three cams 2 are arranged in series and are kept in the intended position along the shaft and in angular position with respect to the shaft by holding means (not shown in any more detail). The cams 2 have in the initial state mating play 3 with respect to the shaft, which allows them to be arranged in series. The shaft 1 bears with its end face against a fixed stop 4.

A piston-shaped drift 5 is fastened on a draw rod a, the annular groove 7 of which can be coupled at its end, facing away from the drift, via pawls 8 of a driving head 9 to the piston rod 10 of a hydraulic operating element 11.

The outer diameter of the drift 5 is larger than the clear width of the hollow shaft 1 by at least the mating play 3 between the shaft 1 and the cams 2. The drift 5 goes from the draw rod 6 to its outer diameter via a cone 12.

In the representation, the drift B has already been pulled soar through the hollow shaft 1 and has permanently deformed the latter in an expanding manner to such an extent that not only has the mating play 3 with the first cam 2 been eliminated but a press fit between the shaft and cam has also been established with such high surface pressure that the cam is fastened on the shaft with the holding force required for its proper function. When the drift 5 is being pulled through the entire length of the shaft 1, the other cams 2 are thus also fastened.

Thereafter the drift 5 can be uncoupled from the driving head 9 by lifting the pawls 8 out of the annular groove 7 and coupled again to the driving head after inserting its draw rod 6 through the next hollow shaft to be processed.

The parameters comprising the mating play 3, Be difference between the outer diameter of the drift 5 and the clear width of the hollow shaft 1, the modulus of elasticity of the material of the shaft 1 and of the cams 2, and the required holding force of the cams on the shaft must of course be coordinated with one another in particular.

In a modification of the embodiment represented it is also possible to use a plurality of drifts 5', 5" in succession or a staged drift, the diameter or diameters of which increase in identical or preferably decreasing stages to the final dimension. In this case, the outer contours of the individual drifts or stages may vary.

The expansion of the shaft 1 achieves the effect of frictional engagement in circular, smooth bores of the cams 2. If the bores of the cams 2 have a profiling, for example in the form of a toothing, the material of the shaft 1 displaced by the drift 5 is pressed into this profiling and a form fit with a much higher holding force is achieved. The profiling may in this case be very coarse, for example in wave form, and the drift 5 may have a corresponding profiling, with the result that the material of the shaft can be pressed in specifically into the valleys of the profiling.

The pulling of the drift 5 through the hollow shaft 1 requires a considerable pulling force, which may be advantageously applied by means of the hydraulic operating element 11. It goes without saying that other operating elements of a different type, such as threaded spindles, can also be used.

The required pulling force depends on several factors, such as them wall thickness of the hollow shaft 1, the rigidity of the material of the shaft, the taper of the cone 12 on the drift 5, the pulling rate of the drift and so on. It is obvious that the resistance of the hollow shaft to the expansion, and consequently the pulling force, is increased significantly at the points at which a cam 2 is seated on the shaft, since this cam 5 hinders the expansion of the shaft.

The increase in the pulling force at these points can be sensed and may serve as an indication of whether the desired secure seating of the cam has been achieved.

For this purpose, there may be fitted on the driving head 9 a force-measuring element, for example in the form of a strain gauge 13, which picks up the pulling force exerted and passes it on to a comparison device 14. On the driving head 9 there is also articulated a linear scale 15, which is sensed by a sensor 16, likewise connected to the comparison device 14.

In a first phase, the pulling force required for the desired holding force of a cam 2 on the hollow shaft 1 and the locations along the hollow shaft at which this pulling force must occur can be determined. These values can be passed on to the comparison device 14. In the following operations, it then compares whether the predetermined values have been reached and emits an error signal if this is not the case. This may happen, for example, if the bore of a cam 2 is oversized, the wall thickness of the hollow shaft is possibly too small at the point concerned, a cam is not seated at the intended point or is missing entirely, etc.

It goes without saying that the use of other types of measured-value pickups, for example load cells or displacement transducers, and the arrangement of the same at other points, for example on the anchorage of the operating element 11 or on the fixed stop 4, are also possible.

What is claimed is:

1. Process for providing a torsionally resistant connection of at least one component arranged on a hollow shaft to the shaft, wherein the component is threaded onto the shaft with mating play and is held in a specific position thereon, further wherein the shaft is expanded by a drift moved through the hollow shaft, the drift being larger in diameter than a width of the shaft, until a desired holding force for the component on the shaft is achieved, the process comprising:

determining in at least one trial run on at least one sample workpiece the amount of force that must be used for moving the drift through a region of the shaft provided with the component in order to achieve a holding force of the component on the shaft subsequently checked on the sample workpiece, storing the determined force and an assigned a region along the shaft thereto, monitoring in subsequent production runs, whether the stored force is at least reached in the region assigned thereto, and emitting an error signal if the stored force does not match the assigned region.

2. Process according to claim 1, wherein at least two drifts of respectively larger outer diameter are successively pulled through the shaft.

3. An apparatus for providing a torsionally resistant connection of at least one component seated on a hollow shaft comprising a drift moveable through the hollow shaft, the drift having a larger diameter than the hollow shaft width thereby permitting the shaft to be expanded until a desired holding force for the component on the shaft is achieved, wherein the apparatus further comprises moving means for the drift attached to a force-measuring means and a displacement-measuring means, the force-measuring means and displacement measuring means being connected to a comparison device, wherein predetermined pushing or pulling forces during the moving of the drift through the hollow shaft are reached at predetermined points along a path of movement of the drift.

4. Apparatus for the torsionally resistant connection of a hollow shaft to at least one part arranged on the shaft, in which the at least one Part is threaded with mating play onto the shaft and is fastened in a specific position on the shaft by eliminating this play, comprising:

at least one drift which can be moved through the shaft and which is of a larger outer diameter than a clear width of the shaft, and moving means of the drift which are assigned a force-measuring means and a displacement-measuring means, which are connected to a comparison device in which reaching of predetermined pushing or pulling forces during the moving of the drift can be sensed at predetermined points along a path of movement of the drift through the hollow shaft.

5. Apparatus according to claim 4, wherein an outer diameter of the drift increases conically in the direction of movement of the drift through the shaft.

6. Apparatus according to claim 4, wherein the drift can be pulled through the shaft.

* * * * *